US006869242B2

(12) United States Patent
May

(10) Patent No.: US 6,869,242 B2
(45) Date of Patent: Mar. 22, 2005

(54) DISPENSER AND PROCESS

(75) Inventor: Richard James May, Saylorsburg, PA (US)

(73) Assignee: James Alexander Corporation, Blairstown, NJ (US)

( * ) Notice: Subject to any disclaimer, the term of this patent is extended or adjusted under 35 U.S.C. 154(b) by 0 days.

(21) Appl. No.: 10/626,381

(22) Filed: Jul. 24, 2003

(65) Prior Publication Data

US 2004/0146334 A1 Jul. 29, 2004

Related U.S. Application Data

(63) Continuation of application No. 09/970,970, filed on Oct. 4, 2001, now Pat. No. 6,641,319, which is a continuation of application No. 09/459,704, filed on Dec. 13, 1999, now Pat. No. 6,379,069, which is a continuation-in-part of application No. 08/790,222, filed on Feb. 3, 1997, now abandoned, which is a continuation-in-part of application No. 08/354, 487, filed on Dec. 12, 1994, now abandoned.

(51) Int. Cl.[7] ..... B43K 5/14

(52) U.S. Cl. ..... 401/132; 222/541.6; 222/490

(58) Field of Search ..... 401/132–135, 401/183–186; 222/490, 494, 541.1, 541.6; 425/525, 527, 577; 264/328, 12, 523, 541

(56) References Cited

U.S. PATENT DOCUMENTS

| | | | |
|---|---|---|---|
| 2,311,367 | A | 2/1943 | Chambers |
| 2,832,087 | A | 4/1958 | McEwan |
| 3,029,987 | A | 4/1962 | Gronemeyer |
| 3,124,828 | A | 3/1964 | Barber et al. |
| 3,248,017 | A | 4/1966 | Allen |
| 3,481,513 | A | 12/1969 | Ram |
| 3,482,920 | A | 12/1969 | Schwartzman |
| 3,684,136 | A | 8/1972 | Baumann |
| 3,757,782 | A | 9/1973 | Aiken |
| 3,759,259 | A | 9/1973 | Truhan |
| 3,831,742 | A | 8/1974 | Gardella et al. |

(List continued on next page.)

FOREIGN PATENT DOCUMENTS

| | | |
|---|---|---|
| BE | 501779 | 3/1951 |
| DE | 3246406 A | 6/1984 |
| EP | 463658 A1 | 1/1992 |
| FR | 1557786 | 1/1969 |
| FR | 2700698 A | 7/1994 |
| IT | 652178 | 2/1963 |
| JP | 6-156513 | 6/1994 |
| NL | 8602366 A | 4/1988 |
| WO | WO 88/09753 | 12/1988 |

OTHER PUBLICATIONS

Douglas M. Bryce, *Plastic Injection Molding . . . Material Selection and Product Design Fundamentals*, undated, pp. 258–261, vol. II: Fundamentals of Injection Molding Series, Society of Manufacturing Engineers.

David B. Guralnik, Editor in Chief, *Webster's New World Dictionary of the American Language*, 1970, p. 973, 2nd College Edition, The World Publishing Company, New York.

*Primary Examiner*—Gregory L. Huson
*Assistant Examiner*—Huyen Le
(74) *Attorney, Agent, or Firm*—Wallenstein Wagner & Rockey, Ltd.

(57) ABSTRACT

A dispenser (10) for use in dispensing liquid or solid material. The dispenser (10) includes wall portions forming a sealed first chamber (18) containing the material and wall portions forming a second chamber (20) and a molded, rupturable membrane (34) disposed between the first chamber (18) and the second chamber (20). The rupturable membrane (34) is preferably a circular disk with a series of molded radial depressions (40) or weld seams (40) extending from a center point of the disk. When pressure is applied directly to the membrane (34), the membrane (34) is fractured along the depressions (40) or weld seams (40). A method is provided for forming the dispenser (10) by injection molding.

20 Claims, 6 Drawing Sheets

U.S. PATENT DOCUMENTS

| | | | | |
|---|---|---|---|---|
| 3,876,314 | A | | 4/1975 | Nehring |
| 3,891,331 | A | | 6/1975 | Avery |
| 3,896,808 | A | | 7/1975 | Szpur |
| 4,183,684 | A | | 1/1980 | Avery |
| 4,378,069 | A | | 3/1983 | Franco |
| 4,432,530 | A | | 2/1984 | Marcinek |
| 4,432,749 | A | | 2/1984 | Snyder et al. |
| 4,620,648 | A | | 11/1986 | Schwartzman |
| 4,674,903 | A | | 6/1987 | Chen |
| 4,765,518 | A | | 8/1988 | O'Meara |
| 4,867,326 | A | | 9/1989 | O'Meara |
| 4,872,556 | A | | 10/1989 | Farmer |
| 4,875,602 | A | | 10/1989 | Chickering et al. |
| 4,884,703 | A | | 12/1989 | O'Meara |
| 4,927,012 | A | | 5/1990 | Rowe |
| 4,990,016 | A | | 2/1991 | Seidler |
| 5,002,198 | A | | 3/1991 | Smith |
| 5,035,348 | A | | 7/1991 | Seifert |
| 5,038,455 | A | | 8/1991 | Guest |
| 5,042,690 | A | | 8/1991 | O'Meara |
| 5,052,589 | A | | 10/1991 | O'Meara |
| 5,100,028 | A | | 3/1992 | Seifert |
| 5,105,985 | A | * | 4/1992 | Kroeber ..... 222/107 |
| 5,152,742 | A | | 10/1992 | Simpson |
| 5,169,030 | A | | 12/1992 | Lewin |
| 5,215,219 | A | | 6/1993 | Gallagher |
| 5,228,593 | A | | 7/1993 | O'Meara |
| 5,244,120 | A | | 9/1993 | O'Meara |
| 5,269,441 | A | | 12/1993 | O'Meara |
| 5,288,159 | A | | 2/1994 | Wirt |
| 5,301,837 | A | | 4/1994 | O'Meara |
| 5,419,450 | A | | 5/1995 | Guglielmelli et al. |
| 5,490,736 | A | | 2/1996 | Haber et al. |
| 5,664,705 | A | | 9/1997 | Stolper |
| 5,924,605 | A | | 7/1999 | Baudin et al. |
| 5,992,692 | A | | 11/1999 | Boissay |

* cited by examiner

DISPENSER AND PROCESS

CROSS-REFERENCE TO RELATED APPLICATIONS

This is a continuation application of U.S. patent application Ser. No. 09/970,970, filed Oct. 4, 2001 now U.S. Pat. No. 6,641,319, which is a continuation of U.S. patent application Ser. No. 09/459,704, filed Dec. 13, 1999, now U.S. Pat. No. 6,379,069, which is a Continuation-in-Part of patent application Ser. No. 08/790,222 (now abandoned), filed Feb. 3, 1997, which is a Continuation-in-Part of patent application Ser. No. 08/354,487 (now abandoned), filed Dec. 12, 1994, which patent applications are incorporated herein by reference.

FEDERALLY SPONSORED RESEARCH OR DEVELOPMENT

Not Applicable.

TECHNICAL FIELD

The invention generally relates to a dispenser for a flowable substance and, in particular, the invention relates to a one piece fluid dispenser having two chambers separated by a membrane.

BACKGROUND OF THE INVENTION

Different types of containers and dispensers for the distribution of material are known within the packaging industry. One example is described in U.S. Pat. No. 3,759,259 issued Sep. 18, 1973 to Andrew Truhan. The Truhan patent discloses a combination applicator and container for medicinal substances. The applicator includes a holder and a fibrous wadding of cotton. The container has flexible walls and a flat seal that spans the container opening. The flat seal is heat sealed to the interior surface of the container. The flat seal is perpendicular to the flexible walls and ruptures upon the application of inward force to the container side walls. In another embodiment, the flat seal includes one or more score lines which form lines of weakness or burst lines when an inward force F is applied to the container side walls.

U.S. Pat. No. 3,684,136 to Baumann discloses a receptacle for receiving and mixing liquid and/or solid substances. The receptacle includes a lower mixing chamber M, an upper secondary chamber S, and a foil dividing wall. The lower surface of dividing wall is convex and the top surface of the wall is concave. In the first embodiment, the surface of the dividing wall features a scored notch(es), that signifies a weakened portion of the dividing wall. The notches can be arranged in a star or cross orientation. To tear the dividing wall, lateral pressure P is applied to receptacle walls adjacent to the dividing wall. When lateral pressure P is terminated, the dividing wall returns to its original shape and the opening will close. In the second embodiment, the receptacle includes outer projections which indicate the direction in which the notches should be disposed during assembly.

In both Truhan and Baumann, the seal separating the chambers has score lines which are formed from the removal of material from the seal itself. The removal of material is necessary to sufficiently weaken the seal structure to facilitate rupture. However, the removal of material compromises the burst strength of the seal and can lead to inconsistent and untimely seal rupture. As a result, the effectiveness of both the seal and the device is reduced.

Furthermore, with both devices it is necessary to under fill the container with liquid leaving ample air space. This under filling increases the chance of accidental seal rupture from pressure on the container. Consequently, the volume of liquid stored within the chamber must be reduced.

Lastly, the dispensers disclosed in Truhan and Baumann are designed to release the entire fluid contents at one time. Thus, the user cannot control the distribution and application of the liquid over a period of time.

The present invention is provided to solve these and other problems.

BRIEF SUMMARY OF THE INVENTION

The present invention provides a dispenser for discharging either a liquid or solid material. To this end, there is a device provided having two adjacent chambers separated from each other by a novel rupturable web or fracturable membrane. The first chamber has a distal end and is a storage chamber for the material. The second chamber has a proximate end and receives the material when released from the first chamber by rupture of the membrane. The first and second chambers are defined by a peripheral wall with an elongated axis forming a sleeve or cylinder. After the material is added to the first chamber, the distal end, the end opposite from the membrane, is sealed to hold the material in the first chamber. The first chamber can be closed off or sealed by pressing the sides of the end of the chamber together and heat sealing or applying an adhesive. Alternatively, the first chamber can be sealed by applying a cap over the end of the tube. The membrane separating the chambers is provided with a weld seam and is broken by lateral force on the membrane to allow the fluid to flow from the first chamber into the second chamber. The thickness of the membrane can be varied, thereby either increasing or decreasing the amount of applied force needed to rupture the membrane.

In accordance with the invention, the web is preferably disk-shaped having a series of radial disposed uniform depressions on one surface of the disk and extending from a center point of the disk in the form, for example, of spokes on a wheel. The thickness of the disk is lesser at the depressions. When the disk is compressed by exerting pressure on the edge of the disk, the web breaks along the depressions forming a series of finger-like triangular projections extending from the face of the disk. Since the fingers are widest where they contact the container wall, the center section of the disk preferably opens first to material flow. The amount of material that can pass into the second chamber is controlled by the degree of opening which corresponds to the depressed areas and the pressure applied to the chamber. In a preferred embodiment, the depressed areas are formed on only one side of the disk but could also have depressed areas on both sides of the disk. The fingers formed as a result of the compression will extend in the direction of the flow of the material. This arrangement permits an even flow of the material.

According to another aspect of the invention, the novel membrane has opposing first and second surfaces and contains a weld seam. The membrane is formed by a first segment of injected molded material that abuts a second segment of injected molded material to form the weld seam. The segments abut at an interface area. The membrane thickness is reduced at the weld seams. In one preferred embodiment, the weld seam comprises a plurality of weld seams that are generally pie-shaped and are molded at right angles to the interior surface of the dispenser. The mold segments are widest at their base where they extend from the interior dispenser surface and narrow as they radially extend toward a center portion of the membrane.

Under normal use and operation, the membrane partitioning the first and second chambers can only be ruptured by the precise administration of force on the membrane. The membrane will not rupture when the first chamber is compressed by normal hand pressure. Conversely, extreme force loads are required to rupture the membrane by compressing the first chamber. Such forces would not be present during normal use and handling of the dispenser.

When the membrane is compressed by exerting pressure on the edge of the membrane, the membrane ruptures only along the weld seams. Unlike prior art devices, the membrane rupture is predictable and controlled at the weld seams. The amount of material which can pass into the second chamber is controlled by the degree of membrane opening which is directly controlled by the amount of force applied to the membrane by the user.

According to another aspect of the invention, the outer surface of the chamber walls can be provided with a marking to indicate the preferred location where force should be applied to rupture the membrane. In one preferred embodiment, the marking is an external extension. Such an extension can be in the form of a thumb pad, which corresponds to the location where force should be applied. Alternately, the outer surface of the chamber can have any type of raised area or projection such as a circular band around the outside of the chamber to indicate the desired point of force application. The outer surface could also have an indicia or other marking to indicate where force should preferably be applied.

In accordance with the invention the dispenser is produced in a unitary configuration by a molding process. The mold has a cavity formed to correspond to the outer surface of the chambers. Two laterally opposed pistons, or core pins, are extended into the mold cavity to form the inner surface of the chambers. An end of one of the pistons is configured with a raised structure that facilitates the formation of weld seams, or depressions on the membrane. The membrane structure can be in many configurations, including but not limited to a cross or star.

The molding process is initiated by the injection of thermoplastic material into the cavity. Once injection is complete, the mold is then cooled by circulating a cooling medium, such as water, in a cavity surrounding the mold. The core pins are then retracted to allow release of the molded product.

The flowable material to be utilized can be fed into the first chamber and the end of the chamber sealed. Because the release of the material depends on the application of pressure to the web to break the weld lines, and not the pressure of the material fluid against the web, it allows the chamber to be filled with small quantities of material. If the seal is to be broken by the pressure of liquid material as in the prior art devices, sufficient liquid has to be present to create the required hydraulic pressure when compressed. Further, the dispenser of the invention allows the dispensing of non-liquids such as a powder which would not exert any hydraulic pressure.

DETAILED DESCRIPTION OF THE INVENTION

Figure 1:
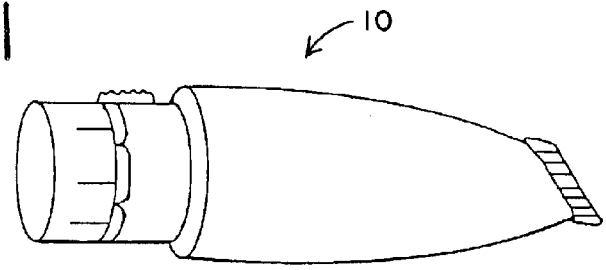
FIG. 1 is a perspective view of a dispenser according to the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
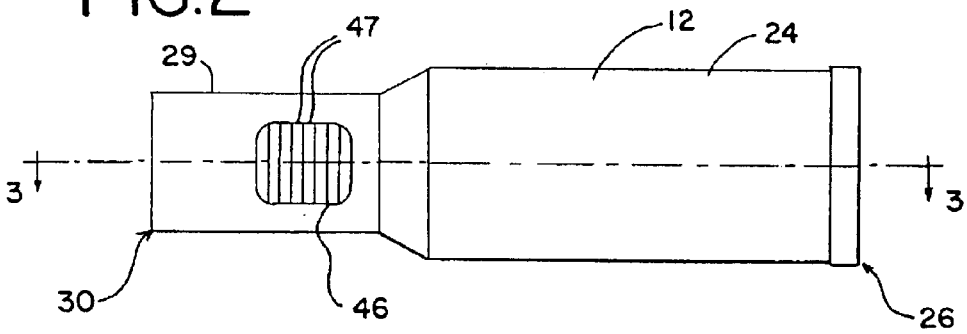
FIG. 2 is a top plan view of the dispenser of FIG. 1 prior to sealing a distal end of the dispenser.
Figure 3:
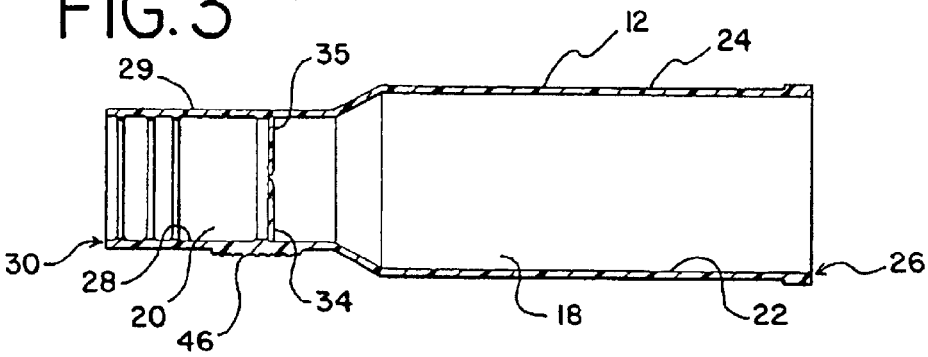
FIG. 3 is a cross-sectional view of the dispenser taken along lines 3—3 in FIG. 2.

Referring to the drawings, FIG. 1 discloses a dispenser according to the present invention generally designated by the reference numeral 10. FIGS. 2 and 3 show the container 12 prior to having one end sealed as will be described in greater detail below. As shown in FIGS. 2 and 3, the dispenser 10 generally comprises a container 12 with an elongate axis L having a peripheral wall 16. In one preferred embodiment, the container 12 is cylindrical. However, the container 12 can be molded in numerous shapes, including an elliptical shape.

As further shown in FIGS. 2 and 3, the container 12 generally comprises a first chamber 18 and a second chamber 20 separated by a web or membrane 34 described in greater detail below. While a two chamber dispenser is one preferred embodiment, more or less chambers can also be defined within the container 12. The first chamber 18, which is adapted to contain the material to be dispensed, has an interior surface 22, an exterior surface 24, and a distal end 26. The second chamber 20 has an interior surface 28, an exterior surface 29, and a proximate end 30. An end portion 32 is located on the exterior surface 24 of the first chamber 18 at the distal end 26. As explained in greater detail below, the distal end 26 of the first chamber 18 can be closed by a number of sealing methods, including heat or adhesive sealing. Alternatively, the distal end 26 can receive a cap to close the first chamber 18. When the distal end 26 is sealed, and in cooperation with the membrane 34, the first chamber 18 is a closed chamber for holding a flowable material such as a liquid medicinal fluid. As also shown in FIG. 3, if desired, the cylinder 12 can be necked down wherein the second chamber 20 has a smaller diameter than the diameter of the first chamber 18.

As shown in FIGS. 3–7, the web 34 is preferably constructed in the form of a disk 35. The disk is preferably a flat plastic sheet having a series of radial depressions 40 on a first surface 36 of the web 34. The radial depressions 40 extend from substantially a center point 33 of the web 34 to an outer edge 37 of the disk, for example, in the form of spokes of a wheel. Compression of the cylinder, such as by finger pressure, causes the web 34 to break, or rupture, only along the radial depressions 40 forming a series of finger-like projections 39 which are displaced in overlapping fashion (FIG. 9) to create web openings 41 for release of the material from the first chamber 18 to the second chamber 20. Since the projections 39 are "pie-shaped" and widest at their outer edges 37, the center section of the web 34 breaks open the widest. The amount of material that can be dispensed through the web 34 is controlled by the degree of the opening 41. The size of the opening 41 is controlled by the configuration of the depressions 40 and the pressure of the fingers of the user pressing on the container 12 to assert pressure on the web 34.

As further shown in FIGS. 3–7, the web 34 or membrane 34 partitions the container 12 to separate and, therefore, define the first chamber 18 and the second chamber 20. Although FIG. 3 shows the membrane 34 closer to the proximate end 30 than the distal end 26, the placement of the membrane 34 is a function of the desired volume capacity of the second chamber 20. As such, the membrane 34 could be located at numerous locations in the cylinder 12.

Figure 4:
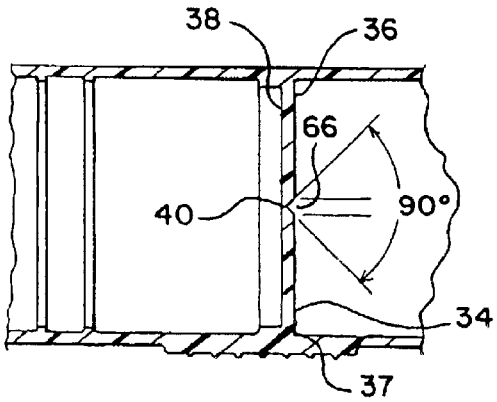
FIG. 4 is an enlarged partial cross-sectional view of a membrane taken from FIG. 3.
Figure 5:
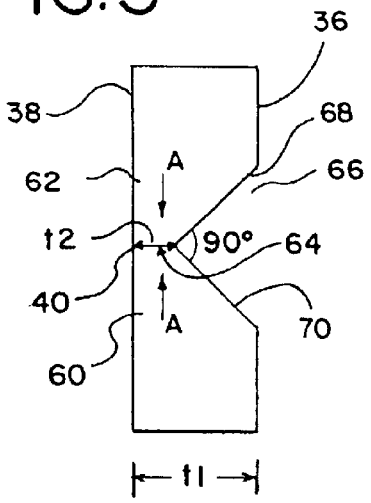
FIG. 5 is another enlarged partial cross-sectional view of the membrane.

As shown in FIGS. 3 and 4, the membrane 34 has a first surface 36 and a second surface 38. The first surface 36 faces towards the first chamber 18, while the second surface 38 faces towards with the second chamber 20. The second surface 38 is substantially planar. The first surface 36, however, has a plurality of bands or mold seams 40 thereon. Also in a preferred embodiment, the membrane 34 is disposed substantially transverse to the elongated axis L of the container 12. As will be described in greater detail below, and as generally shown in FIGS. 5–6, and 13–14, a first segment 60 of injected molded material abuts a second segment 62 of injected molded material to form the weld seam 40. As can be further seen in FIG. 5, the membrane 34 has a base thickness "t1" between the first membrane surface 36 and the second membrane surface 38. The thickness t1 is generally referred to as the membrane thickness. The weld seam 40 has a thickness t2 that is less than the membrane thickness t1. This facilitates rupture of the membrane 34 as described below. The first mold segment 60 and the second mold segment 62 abut to form the weld seam 40. During the molding process, the mold segments 62,64 move toward the interface area 64 in the directions of arrows A. Furthermore, the mold segments 60,62 meet substantially at the interface area 64 at the lesser thickness t2. This forms the weld seam 40 at the lesser thickness facilitating rupture of the membrane 34. If the mold segments 60,62 did not meet at the interface area 64 but, for example, substantially further to either side of the interface area 64, the weld seam 40 would be too thick and not be able to rupture. Whichever mold segment 60,62 moved past the interface area 64, the segment would merely flex and not rupture as desired. Thus, as described below, the molding process is controlled to insure that the mold segments abut substantially at the interface area 64 to form the weld seam 40 having a thickness t2 less than the membrane thickness t1.

Figure 6:
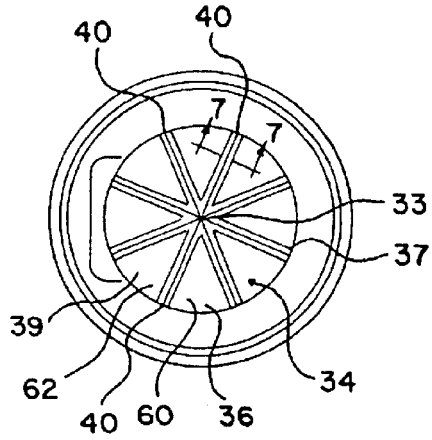
FIG. 6 is an end view of the dispenser facing into a first chamber.
Figure 7:
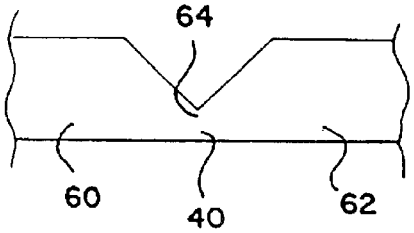
FIG. 7 is a cross-sectional view of a weld line taken along lines 7—7 of FIG. 6.

As shown in FIG. 6, the membrane 34 preferably contains a plurality of weld seams 40, which can be arranged in a number of configurations including but not limited to a cross, star, or asterisk. It is understood, however, that the benefits of the invention can be realized with a single weld seam 40 formed from a pair of mold segments abutting one another. In a preferred embodiment, the weld seams 40 are arranged in a asterisk configuration wherein the membrane has a pie-shape. Adjacent mold segments 60,62 abut with one another to form the weld seams 40. Due to the configuration of the mold to be described below, the weld seams 40 are formed to have a lesser thickness t2 than the membrane thickness t1. As further shown in FIG. 6, the plurality of weld seams 40 extend radially from substantially a center point 37 on the membrane 34 completely to an outer edge of the membrane 34 and to the interior surface of the container 12. It is understood, however, that the weld seams 40 do not need to extend to the outer edge of the membrane 34. In a most preferred embodiment, the membrane 34 has eight mold segments, or four pairs of mold segments 60,62. The eight mold segments cooperate wherein adjacent mold segments abut at eight separate interface areas 64 to form eight weld seams 40. As shown in FIG. 14, the process is controlled such that the adjacent mold segments each meet at the separate interface areas 64. Each weld seam 40 has a thickness less than the thicknesses of the segments. The thicknesses of the mold segments are considered to be the membrane thickness t1.

Explained somewhat differently, the first surface 36 of the membrane 34 has a channel 66 formed therein. The mold seam 40 confronts the channel 66. The channel is formed by a first wall 68 adjoining a second wall 70. In a preferred embodiment, the first wall 68 adjoins the second wall 70 at substantially a 90 degree angle. Acute angles or obtuse angles are also possible. Thus, in one preferred embodiment, the channels are V-shaped.

As shown in FIGS. 1–3, the exterior surface 28 of the container 12 has an exterior extension 46 to indicate the exact location where force should be applied to rupture the membrane 34. Specifically, the extension 46 is located directly adjacent to the membrane 34. Although the extension 46 is shown as a thumb pad with a plurality of ridges 47, any type of raised area or projection including a button, prong or ring will suffice. In addition, a ring of material could be applied around the perimeter of the container 12 corresponding to the location of the web 34 so that a user would know precisely where to apply finger pressure. An indicia-bearing marking would also be sufficient.

Figure 8:
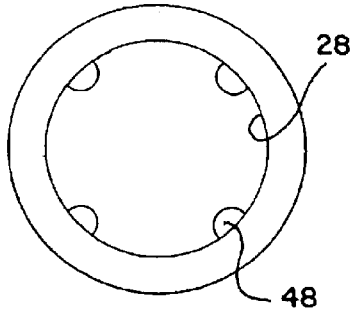
FIG. 8 is an end view of the dispenser facing into the second chamber.
Figure 10:
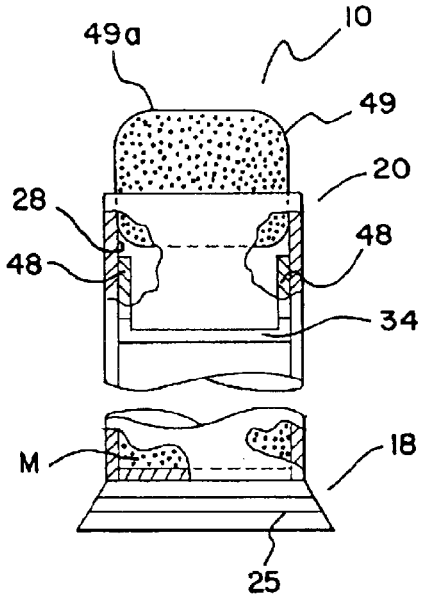
FIG. 10 is partial elevational view of the dispenser supporting a swab.

As shown in FIGS. 8 and 10, the interior surface 28 of the second chamber 20 has a plurality of longitudinal ribs 48. The ribs 48 are oriented axially in the second chamber 20 and can be of varying length. The ribs 48 could be shortened and extend radially inwardly. The ribs 48 secure different applicators, such as a swab (FIG. 10), which can be used to apply the dispensed liquid or solid material. The swab forms an interference fit with the ribs 48.

In a preferred embodiment, the dispenser 10 is made of a transparent, flexible thermoplastic material. The preferred plastic material is polyethylene or polypropylene but a number of other plastic materials can be used. For example, low-density polyethylene, polyvinyl chloride or nylon copolymers can be used. In a preferred embodiment, a mixture of polypropylene and polyethylene copolymer or thermoplastic olefin elastomer is used. In another preferred embodiment, a mixture of polypropylene and Flexomer®, available from Union Carbide, is utilized. It is essential that the dispenser be made of material which is flexible enough to allow sufficient force to rupture the membrane 34.

Figure 9:
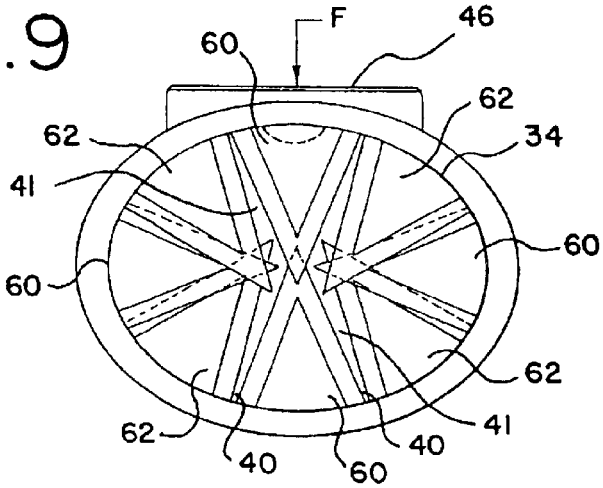
FIG. 9 is an elevational view of the membrane having forces applied thereto wherein the membrane is fractured along weld lines.

As shown in FIG. 9, in operation, a user applies a selective force F on the dispenser 10 at the exterior extension 46 adjacent to the membrane 34. When sufficient force is applied, lateral pressure is applied to the membrane 34 causing the membrane 34 to shear and rupture along the weld seams 40. The membrane 34 ruptures only along the mold seams 40 to create membrane openings 41. Upon rupture of the membrane 34, material passes from the first chamber 18 through the membrane 34 and into the second chamber 20. The material flow rate through the membrane 34 and into the second chamber 20 is controlled by the degree of membrane 34 opening which is directly related to the amount of force applied to the membrane 34 by the user. Therefore, the user can precisely regulate the flow of material after rupture of the membrane 34. In addition, the membrane 34 can preferably have elastic characteristics wherein when force is removed, the membrane 34 returns substantially to its original position. While the mold seams 40 may be ruptured, the segments 60,62 can form a close enough fit to prevent material from flowing past the membrane 34 without additional pressure on the material. Thus, the membrane 34 can act as a check valve to prevent unwanted discharge of the material.

FIG. 10 shows another embodiment of the dispenser of the present invention. Like elements will be referred to with identical reference numerals. The dispenser 10 has a first chamber 18 and a second chamber 20 separated by a membrane 34. The first chamber 18 has a closed end wall 25 enclosing material M. The second chamber 20 receives an applicator or swab 49. The swab 49 engages the inner surface 28 of the second chamber 20 and in particular the longitudinal ribs 48 to form an interference fit. Once the membrane 34 is fractured as described, the swab 49 receives and absorbs the material M as it is dispensed from the first chamber 18 and into the second chamber 20. The swab 49 has a contact surface 49*a* that is used to dab a desired area such as a skin surface having an insect bite. The dispenser 10 can be inverted and squeezed until the swab surface 49*a* is wet. The dispenser 10 can then be held in a vertical position with the swab 49 pointed upwardly. Alternatively, the swab 49 can be made of a material of relatively large porosity for passing droplets through the swab 49 by gravity and for dispensing droplets from its exterior surface. The swab 49 can be made of polyester, laminated foamed plastic, cotton or the like.

Figure 11:
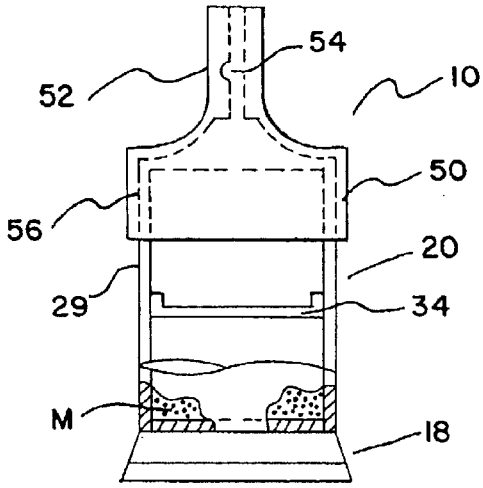
FIG. 11 is a partial elevational view of the dispenser supporting a dropper.

FIG. 11 shows the dispenser 10 having a dropper attachment. The second chamber 20 has a dropper 50. The dropper has an elongate spout 52 with a passageway 54 for dispensing droplets of the material M. The dropper 50 has a cup-like portion 56 that overlaps a portion of the outer surface 29 of the second chamber 20. Once the membrane 34 is ruptured as described and material M passes from the first chamber 18 to the second chamber 20, droplets of the material M can be dispensed through the spout 52.

The preferred dispenser 10 has a length of about 1.5 to about 3.0 inches, although larger containers can be utilized, with 2 to about 2.5 inches being preferred. The outside diameter of the container is about 0.30 to about 1.0 inches.

The wall thickness is about 0.018 to about 0.035 inches and preferably about 0.022 inches. The first chamber 18 is preferably from about 1.30 to about 2.7 inches. The exterior extension 46 is preferably about 0.10 to about 0.50 inches in width and about 0.010 to 0.125 inches thick. The second chamber 20 is preferably about 0.20 to about 1.5 inches and preferably 0.75 inches in length. The membrane 34 preferably has a thickness of about 0.02 to about 0.0625 inches. The mold seams 40 have a preferable thickness of about 0.003 to about 0.008 inches and preferably about 0.005 inches. The above dimensions can be varied depending upon overall dispenser size.

In another preferred embodiment, the membrane 34 forms eight narrow spokes of substantially uniform width extending from the center of the membrane 34 to the inner wall of the container 12. Each spoke extends at a 45 degree angle from the adjacent spokes on either side.

Figure 12:
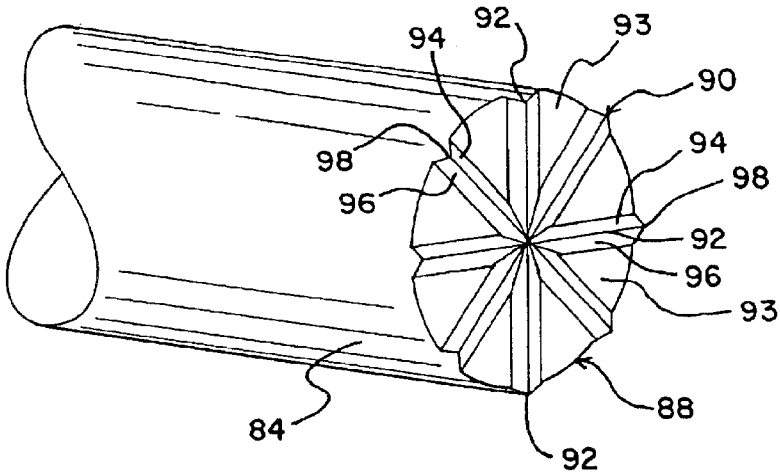
FIG. 12 is a partial perspective view of a core pin having an end face with a raised structure.
Figure 13:
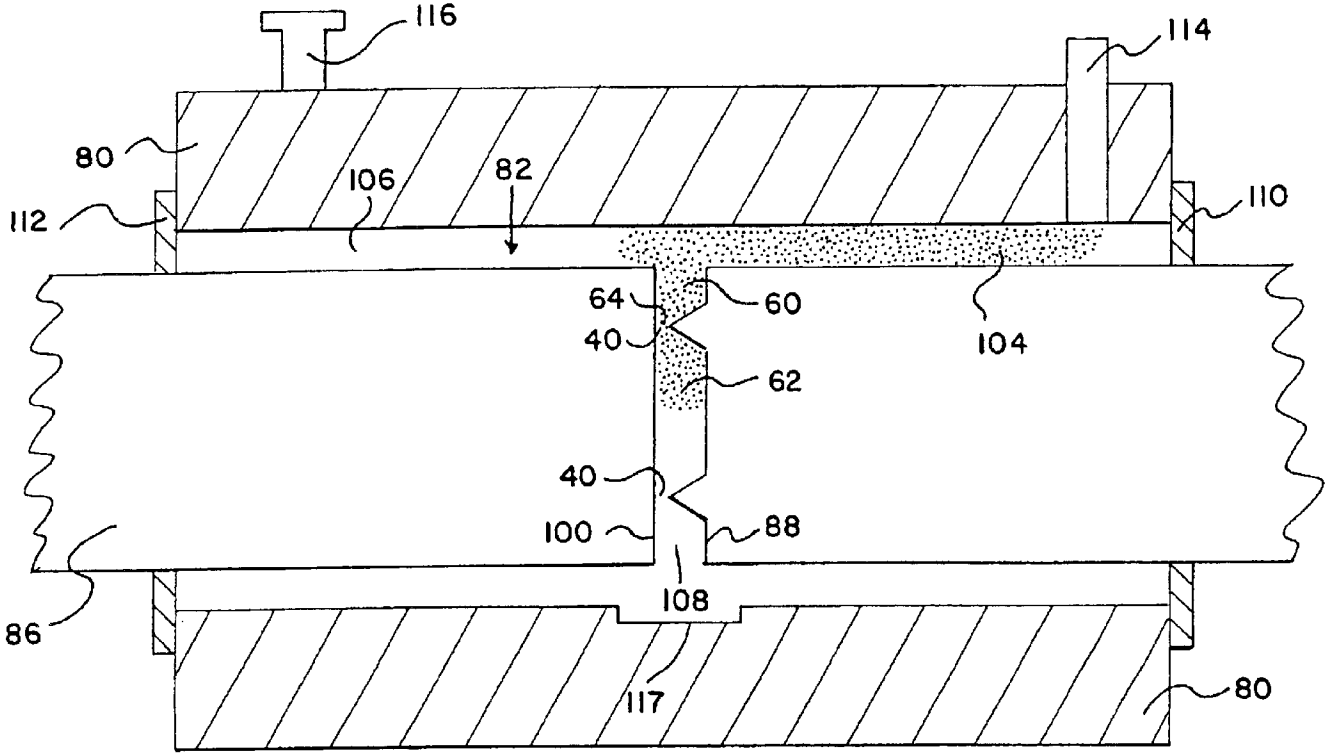
FIG. 13 is a cross-sectional view of a mold and a portion of the material for forming the dispenser.
Figure 14A:
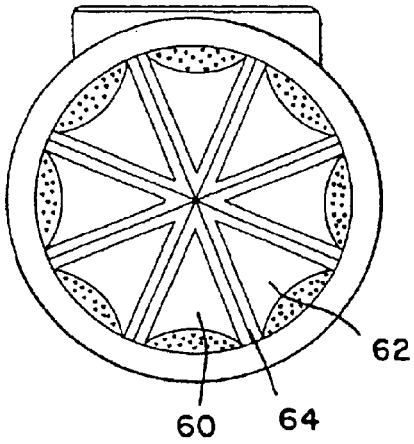
FIGS. 14*a*–14*f* are a series of views showing the injection molding process of the membrane wherein adjacent mold segments abut to form weld lines.
Figure 14B:
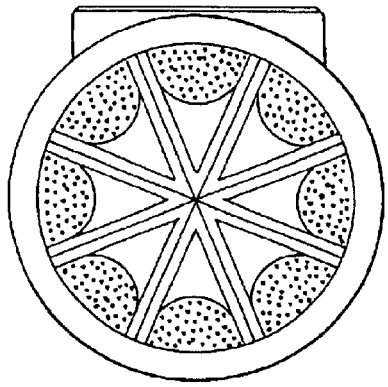
Figure 14C:
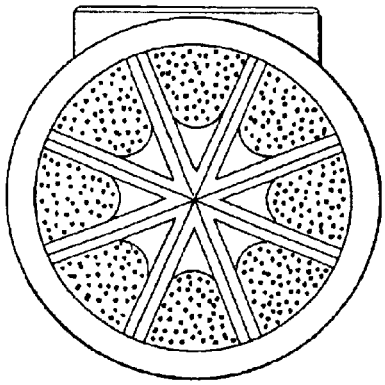
Figure 14D:
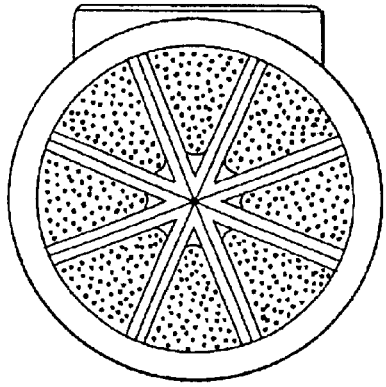
Figure 14E:
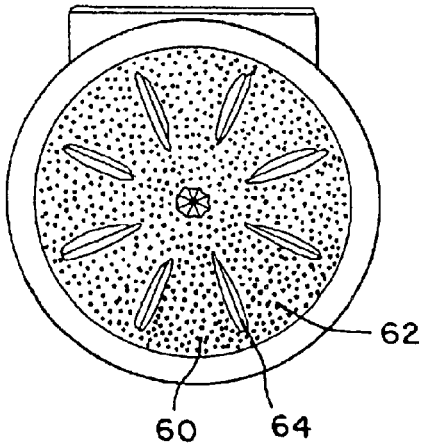
Figure 14F:
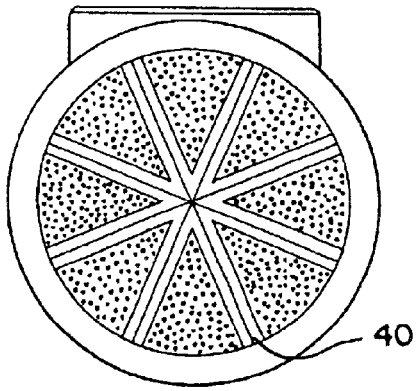

The method of making the dispenser 10 is generally illustrated in FIGS. 12–16. The dispenser 10 is produced in a single molding operation thus providing a one-piece injected-molded part. As shown in FIG. 13, a mold 80 is provided having a mold cavity 82 therein. The mold cavity 82 is dimensioned to correspond to the exterior surface of the dispenser 10. A first core pin 84 and a second core pin 86 are provided. The core pins 84,86 are dimensioned to correspond to the interior surface of the dispenser 10. The second core pin 86 has a generally planar end face 100.

As shown in FIG. 12, the first core pin 84 has an end face 88 having a raised structure 90 thereon. The raised structure 90 is in the form of a ridge 92. The ridge 92 is what provides the depressions or weld seams 40 at the certain thickness in the membrane 34. In a preferred embodiment, the ridge has a first wall 94 adjoining a second wall 96 to form a line 98. Furthermore, in a preferred embodiment, the ridge 92 comprises a plurality of ridges radially extending from a center point of the end face. The ridges define a plurality of membrane segments, or mold gaps 93, between the ridges 92. Thus, it can be understood that the raised structure 90 in the form of the ridges 92 provides the corresponding structure of the membrane 34. Although shown as triangular, the ridges 92 can be formed in a number of shapes, including square or rounded. In addition, the ridges 92 can be arrayed in a multitude of shapes, including a single line, a cross, a star, or an asterisk. Varying the shape of the ridges 92 will affect the shape of the channels 66. The first core pin 84 can be cylindrical but in another preferred embodiment, it can be elliptical.

The first core pin 84 is inserted into the mold 80 with the raised structure 90 facing into the mold cavity 82. A first space 104 is maintained between the mold 80 and the length of the first core pin 84. The second core pin 86 is also inserted into the mold cavity 82 wherein a second space 106 is maintained between the mold 80 and the second core pin 86. The core pins 84,86 are generally axially aligned wherein the end face 88 of the first core pin 84 confronts the end face 100 of the second core pin 86 in spaced relation. Thus, a membrane space 108 is defined between the end faces 88,100 of the core pins 84,86. End plates 110,112 are installed on end portions of the mold 80 to completely close the mold. An exterior extension cavity 117 is located on the surface of the mold 80 and adjacent to the membrane space 108.

Molten thermoplastic material is injected into the mold cavity 82 through an inlet 114. The material flows into the first space 104, second space 106 and membrane space 108. The plastic injection is controlled such that the plastic enters the membrane space 108 simultaneously in the circumferential direction. The raised structure 90 separates the material into separate mold segments 60,62 that flow into the mold gaps. As shown in FIGS. 13 and 14, the mold segments 60,62 flow first into the wider portions of the mold gaps as this is the area of least resistance. The material continues to flow into the membrane space and then the adjacent mold segments 60,62 abut at the interface area 64 to form the weld seams 40. As can be appreciated from FIG. 13, the mold seams 40 have a lesser thickness than the membrane thickness. During this process, air is vented from the mold cavity 82 as is conventional.

Once the plastic injection is complete, the material is allowed to cool. A cold water cooling system 116 could be utilized wherein cold water is pumped into the mold 80 outside of the cavity 82 if desired. Once cooled, the dispenser 10 can be removed from the mold 80.

Figure 15:
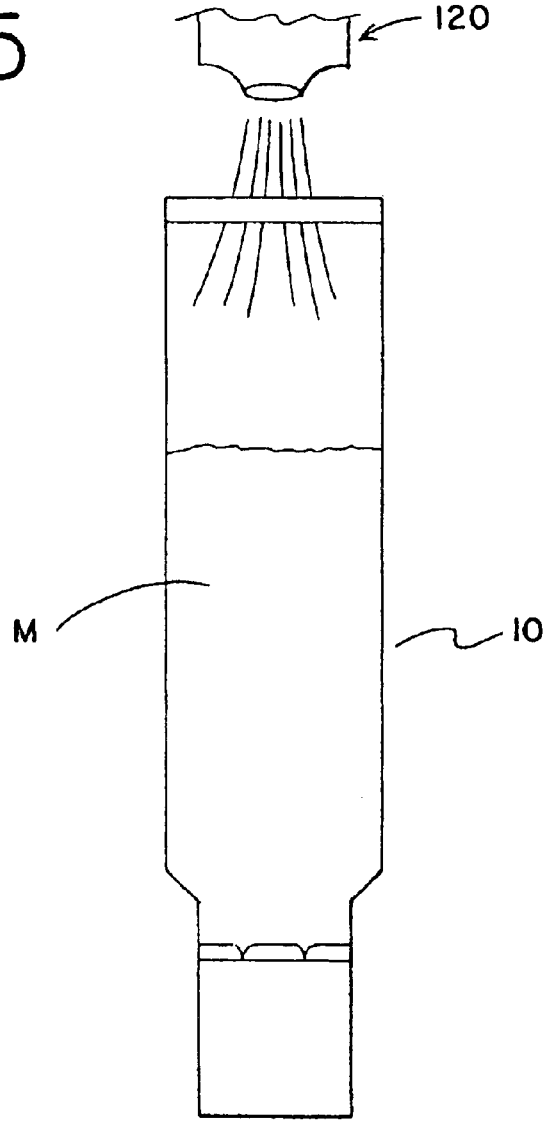
FIG. 15 is a schematic view of the dispenser supporting in a filling apparatus.
Figure 16:
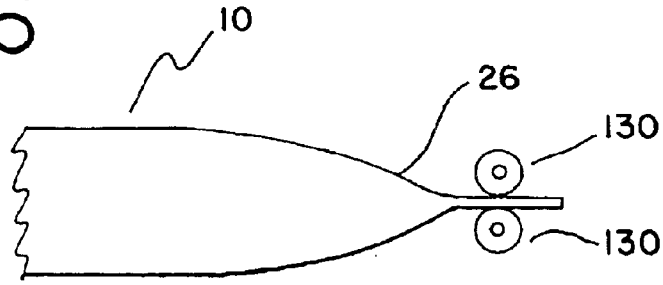
FIG. 16 is a schematic view of a sealing apparatus for sealing the material into the dispenser.

As shown in FIG. 15, the dispenser 10 can be passed on to a filling apparatus 120. The dispenser 10 is then filled with a flowable material M. As shown in FIG. 16, the distal end 26 of the dispenser 10 is sealed by sealing dies 130. The excess end portion 32 can then be cut-off and discarded.

Thus, a one-piece injection molded dispenser is provided. The one-piece construction provides a more repeatable part and at greater manufacturing efficiency than providing a separate piece that is secured into a container. If desired, however, the membrane could be separately molded and affixed into a container. A one-piece molding process, however, is preferred. In addition, because the membrane is molded to have the weld seams, radial depressions, or bands, an additional manufacturing step such as scoring is unnecessary. This allows the manufacture of dispensers having relatively small diameters since there is no need to allow sufficient clearance for a scoring tool. In such small configurations, it is difficult to control the scoring operation. By forming the depressions by injection molded, the desired thicknesses can be closely controlled. The membrane also resists rupture from hydraulic pressure while being easily rupturable when forces are applied to the membrane. Also, the construction of the membrane allows for the precise control of material to be dispensed by controlling the amount of force on the membrane. It is further understood that the depressions or channels could be formed on both sides of the membrane if desired. In such configuration, however, the ability of the membrane to also function as a check valve is lessened. In a preferred embodiment, however, the membrane has the depressions molded on only one side. It is further understood while certain dimensions are preferred for certain embodiments, dispensers of all sizes having similar relative dimensions can be formed according to the present invention.

While the invention has been described in its preferred embodiments, it is to be understood that the words which have been used are words of description rather than limitation and that changes may be made within the purview of the appended claims without departing from the true scope and spirit of the invention in its broader aspects. As an illustration, although the applicator has been described as being utilized for mechanical uses, it can similarly be used for applying adhesives, mastic or the like.

What is claimed is:

1. A method for dispensing flowable material from a dispenser, the method comprising the following steps:

providing a dispenser having at least one chamber configured to contain the flowable material to be dispensed, the dispenser further having a membrane that seals the chamber, wherein the membrane contains at least one weld seam;

applying force to the dispenser to rupture the membrane along the weld seam; and, dispensing the flowable material through the membrane.

2. The method for dispensing of claim 1, further providing a dropper attached to an end of the dispenser, the dropper adapted to dispense the flowable material.

3. The method for dispensing of claim 2, wherein the dropper is removably attached to the dispenser end.

4. The method for dispensing of claim 1, further providing a swab attached to an end of the dispenser, the swab adapted to absorb and then dispense the flowable material.

5. The method for dispensing of claim 4, wherein a portion of the swab is received by the end of the dispenser.

6. The method for dispensing of claim 4, wherein a portion of the swab engages an interior surface of the dispenser to retain the swab within the dispenser.

7. The method for dispensing of claim 1 wherein the flowable material is a liquid.

8. The method for dispensing of claim 1 wherein the flowable material is a powder.

9. The method for dispensing of claim 1 wherein the flowable material is a gel.

10. The method for dispensing of claim 1 wherein the flowable material is granulated.

11. A method for dispensing flowable material from a dispenser, the method comprising the following steps:

providing a dispenser having a first chamber and a second chamber partitioned by a membrane, wherein the first chamber initially contains the flowable material to be dispensed, and wherein the membrane contains at least one weld seam; and, applying force to the dispenser at the membrane to rupture the membrane along the weld seam and create a membrane opening to dispense the flowable substance therethrough.

12. The method for dispensing of claim 11 wherein the weld seam is formed from two abutting segments of injected material.

13. The method for dispensing of claim 11 further providing a dropper attached to a portion of the second chamber, the dropper adapted to dispense the flowable material.

14. The method for dispensing of claim 11 further providing a swab attached to a portion of the second chamber, the swab adapted to absorb and then dispense the flowable material.

15. The method for dispensing of claim 11 wherein the flowable material is a liquid.

16. The method for dispensing of claim 11 wherein the flowable material is a powder.

17. The method for dispensing of claim 11 wherein the flowable material is a gel.

18. The method for dispensing of claim 11 wherein the flowable material is granulated.

19. A method for dispensing flowable material from a dispenser, the method comprising the following steps:

providing a dispenser having at least one chamber configured to contain the flowable material to be dispensed, the dispenser further having a membrane that seals the chamber, wherein the membrane contains at least one weld seam;

applying force to the dispenser coincident to the membrane to rupture the weld seam and create an opening in the membrane to dispense the flowable substance; and, continuing to apply force to the dispenser to dispense the flowable material through the opening in the membrane.

20. The method for dispensing of claim 19 wherein the force is applied to the dispenser in a radially inward direction from an outer surface of the dispenser.

* * * * *